US008845127B2

(12) United States Patent
Deppe

(10) Patent No.: US 8,845,127 B2
(45) Date of Patent: Sep. 30, 2014

(54) LED LAMP

(75) Inventor: Carsten Deppe, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/806,340

(22) PCT Filed: Jun. 30, 2011

(86) PCT No.: PCT/IB2011/052889

§ 371 (c)(1), (2), (4) Date: Dec. 21, 2012

(87) PCT Pub. No.: WO2012/004708

PCT Pub. Date: Jan. 12, 2012

(65) Prior Publication Data

US 2013/0093309 A1 Apr. 18, 2013

(30) Foreign Application Priority Data

Jul. 5, 2010 (EP) ..... 10168385

(51) Int. Cl.
*F21V 21/00* (2006.01)

(52) U.S. Cl.
CPC ..... *F21V 21/00* (2013.01)
USPC ..... 362/217.13; 362/249.02

(58) Field of Classification Search
CPC ..... F21V 21/00
USPC ..... 362/217.13, 249.02; 315/74
See application file for complete search history.

(56) References Cited

U.S. PATENT DOCUMENTS

| | | | | |
|---|---|---|---|---|
| 2,108,633 | A | 2/1938 | Wiegand et al. | |
| 2011/0199769 | A1 * | 8/2011 | Bretschneider et al. | 362/249.02 |
| 2012/0008315 | A1 * | 1/2012 | Simon et al. | 362/217.13 |
| 2013/0057147 | A1 * | 3/2013 | Dellian | 315/74 |

FOREIGN PATENT DOCUMENTS

| | | | |
|---|---|---|---|
| CN | 101737664 | A | 6/2010 |
| DE | 202008015948 | U1 | 4/2009 |
| NL | 2002333 | C | 6/2010 |
| WO | 2009067074 | A1 | 5/2009 |
| WO | 2010069983 | A1 | 6/2010 |

* cited by examiner

*Primary Examiner* — Mary Ellen Bowman
(74) *Attorney, Agent, or Firm* — Yuliya Mathis

(57) ABSTRACT

An LED lamp is disclosed herein. In one embodiment, the LED lamp comprises one LED unit arranged in a housing, a first and a second lamp cap being arranged spaced from each other on opposing ends of the housing, said lamp caps each comprising at least one contact element for connecting said LED unit with a lamp fixture. In one embodiment, said first lamp cap comprises contact breaking means, configured to electrically disconnect said contact elements of said first and second lamp caps from each other when said LED lamp is removed from said lamp fixture.

11 Claims, 8 Drawing Sheets

LED LAMP

FIELD OF THE INVENTION

The invention relates to the field of lighting and to an LED lamp with a first and second lamp cap.

BACKGROUND OF THE INVENTION

At present, lighting devices or lamps are available using light emitting diodes (LEDs), e.g. for general room or office lighting applications. Such LED lamps provide a high luminous flux, while being very energy efficient. In view of the present efforts regarding energy conservation, LED lamps are recently developed to replace common incandescent or fluorescent light sources, i.e. for retrofit applications.

A particular need exists to retrofit lighting devices using fluorescent lamps because of environmental issues due to the use of toxic substances, such as mercury, inside the lamp. Since for the described retrofit applications it is necessary to allow a user to install or replace the lamp, safety is an important aspect. Thus, care has to be taken that the user does not get into contact with any life electrical components, i.e. components energized with an operating voltage, in particular when replacing the lamp, which may easily result in a hazardous electric shock.

It is therefore an object to provide an LED lamp, which can be safely handled, reducing the risk of electric shock.

SUMMARY OF THE INVENTION

An LED lamp and a method of operating the LED lamp are disclosed.

The LED lamp for retrofit applications and shows an improved safety in particular for the de-installation process. When removing a double-capped lamp from a common fixture, it is possible for the user to disconnect the lamp from the two sockets of the fixture successively, i.e. one after another. Thus, it might be possible that the user touches a life part of a first lamp cap of the lamp, while a second lamp cap is still connected with the fixture. With typical fluorescent lamps, no current path through the lamp, i.e. a conducting circuit, is given when the lamp is in a de-energized state, since without a gas discharge, such lamps typically exhibit high impedance. However, a current path is present when using a lamp with an LED unit.

The LED lamp comprises at least one LED unit arranged in a housing and a first and a second lamp cap being arranged spaced from each other on opposing ends of the housing. The first and second lamp caps each comprise at least one contact element for connecting said LED unit with a lamp fixture. The first lamp cap further comprises contact breaking means, configured to electrically disconnect said contact elements of said first and second lamp caps from each other when said LED lamp is removed from said lamp fixture.

An internal current path between said first and second lamp caps, e.g. through the LED unit, is interrupted upon removal of the lamp from the fixture. The risk of an electric shock when touching a contact element of one of the lamp caps is thus advantageously reduced. In the context of the present invention, it is understood that the LED lamp is removed from the fixture, when at least one of the lamp caps is disconnected from said fixture.

The LED lamp can be used for a retrofit applications, i.e. when replacing common fluorescent lamps, since no alteration is necessary on the side of the fixture, while providing improved safety.

The LED lamp comprises at least one LED unit, arranged in a housing. In terms of the present invention, the "LED unit" comprises at least one solid state light source, such as an inorganic LED, organic LED or a solid state laser, e.g. a laser diode. The LED unit may certainly comprise further electric or electronic circuitry, such as an electronic driver or ballast unit.

For general lighting applications, the LED unit may preferably comprise at least one high-power LED, i.e. having a luminous flux of more than 1 lm. Preferably, said high power LED provides a luminous flux of more than 20 lm, most preferred more than 50 lm. For retrofit applications, it is especially preferred that the total flux of the LED unit is in the range of 300 lm to 10000 lm, which corresponds to a typical 5 W-80 W fluorescent tube lamp.

The LED unit may comprise more than one light source, for example in applications where color-control of the emitted light is needed, e.g. using RGB-LEDs or to further increase the luminous flux of the LED lamp. Furthermore, the LED lamp may comprise more than one LED unit or further components, such as additional electric or electronic circuitry, e.g. for color control in case of an RGB-lamp, a reflector or any other type of optical component, depending on the application.

Said housing of the lamp may be of any suitable geometry and dimensions for accommodating the at least one LED unit. The housing may be formed entirely closed or may be provided with one or more openings, e.g. for ventilation purposes. The housing should provide protection against accidental contact of user with any live electrical parts at least in an operational state of the lamp, i.e. a state where the lamp is energized with an operating voltage.

The housing may be of any suitable material, such as metal, glass or plastic material. Preferably, at least a section of the housing is transparent, e.g. formed from transparent plastic material or glass. Preferably, the housing is elongated, defining a longitudinal lamp axis. Most preferably, the housing is axially symmetrical about the lamp axis, the housing may thus e.g. be in the form of a tube.

The LED lamp further comprises at least a first and a second lamp cap being arranged spaced from each other on opposing ends of the housing. The lamp caps further each comprise at least one contact element for connecting said at least one LED unit with a lamp fixture.

The first and second lamp cap may be of any suitable geometry and dimensions and at least provide an electrical connection of the LED unit with the lamp fixture when the lamp is installed in the fixture and thus with a suitable power supply, connected with said lamp fixture. Although it is preferred that the lamp caps are directly connected with the LED unit, e.g. with corresponding wiring, further intermediate circuitry may be present, such as a power converter.

The lamp caps and/or the contact elements certainly should be adapted to the specific type and design of the lamp fixture. The lamp caps and/or the contact elements may further be adapted to mechanically support the LED lamp when installed in the lamp fixture. Preferably, said first and second lamp caps are arranged on axially opposing ends of the housing of the LED lamp.

The contact elements may be of any suitable type to make an electrical contact with corresponding sockets of said lamp fixture and thus to connect the at least one LED unit with power. The contact elements may for example be formed from a metallic material and may each comprise an e.g. elongated contact pin for engagement with a contact slot, formed in a corresponding socket of the fixture. Depending on the application, the lamp caps may each be provided with more than one contact element, e.g. a bi-pin base. Preferably, the contact elements are arranged to extend from the lamp caps outwards parallel to the lamp axis.

The lamp caps and/or the contact elements may be adapted to be connected with any suitable type of fixture. In the context, a fixture may comprise two sockets for engagement with the lamp caps. The fixture may e.g. be formed integrally with the lamp sockets or may comprise several spaced components, electrically connected with a suitable power supply.

The LED lamp may preferably be a retrofit lamp, e.g. adapted to be connected to a fluorescent lamp fixture and to replace a fluorescent lamp designed for the specific fixture. Most preferably, the LED lamp is a retrofit lamp, i.e. having the electrical and/or mechanical properties of a T5- or T8-fluorescent lamp. Preferably, the LED lamp is a tube lamp, such as a linear tube lamp. Especially preferred, the LED lamp is a double-capped tube lamp.

At least said first lamp cap further comprises contact breaking means, configured to electrically disconnect said contact elements of said first and second lamp caps from each other when said LED lamp is removed from said lamp fixture.

Said contact breaking means may be of any suitable type to electrically disconnect the contact elements from each other when said LED lamp is removed from the fixture. It is understood that when the contact elements are disconnected from each other, no electrical connection or current path is given between the contact elements of said first and second lamp caps.

The contact breaking means may comprise any type of suitable component, e.g. a mechanical or electronic switch, such as a contact breaker, relay, a reed contact or a suitable type of transistor, triac or tyristor. The contact breaking means should provide a reliable circuit interruption in said disconnected state, i.e. having a sufficiently high isolation voltage according to the specific application and voltage level of the fixture. Preferably, the contact breaking means are mechanically actuated to disconnect said contact elements. The contact breaking means may be arranged entirely inside of the lamp cap, however, depending on the respective setup of the lamp, the contact breaking means may comprise components, arranged outside of the lamp cap and may e.g. extend into the housing of the LED lamp. In particular in case the lamp cap is provided with a bi-pin base, the contact breaking means may be provided with two switchable contacts to connect both pins separately with the LED unit.

Certainly, the LED lamp may be provided with corresponding contact breaking means on both sides, i.e. in both lamp caps, to further enhance the safety of the device, for example in case the housing of the LED lamp is damaged or defect.

According to a embodiment of the invention, the contact breaking means are adapted to disconnect said contact elements from each other when said LED lamp is rotated and/or displaced linearly against the lamp fixture.

The present embodiment is especially advantageous in case of a retrofit lamp for fluorescent lamp fixtures, since with common type of fixtures the lamp needs to be displaced during deinstallation prior to a removal. As mentioned above, typical sockets of fixtures comprise a contact slot, in which the contact elements engage. To remove the lamp from a first type of fixture, the contact slot of the socket and thus the lamp is rotated about 90° to an installation position. With a second type of fixture, the contact elements are displaced linearly along the axis of the slot to remove the lamp. Here, the contact elements typically are held safely in an operating position of the fixture by contact-springs in the sockets to safely hold the lamp. In either case, the lamp is displaced prior to the contact elements being exposed, so that the present embodiment allows to remove any dangerous voltage from the contact elements before a deinstalled contact element may be touched by the user.

Preferably, the contact breaking means are adapted to disconnect said contact elements from each other when the LED lamp is rotated or displaced linearly. Most preferably, the contact breaking means are configured to disconnect said at least one contact element of said first lamp cap from said LED unit. The present embodiment advantageously provides a very simple setup of the LED lamp.

According to a preferred embodiment of the invention, the contact breaking means comprise a switching member, which is displaceable from a connected state in which said contact element are electrically connected with each other, to a disconnected state, in which said contact elements are disconnected from each other.

The switching member may be of any suitable type and geometry to allow a simple displacement from the connected state to said disconnected state and preferably vice versa, so that the contact elements are safely disconnected from each other when said lamp is removed from the fixture. In the connected state, the contact elements of the first and second lamp cap are electrically connected with each other, so that an electrical circuit or current-path is present in the lamp. Certainly, it is not necessary that the contact elements be directly connected with each other. Preferably, the contact elements of the first and second lamp cap each are connected with the LED unit.

The switching member may e.g. comprise at least one contact and being displaceable against a further fixed contact to allow to disconnect the contact elements of the lamp caps from each other. Alternatively, the switching member may be provided with a magnetic part, so that the switching member activates or deactivates a magnetic proximity switch, such as reed switch, by bringing the magnetic part close to the switch or moving the magnetic part away from the switch, respectively. Preferably, the switching member is arranged to be displaced along an axis, perpendicular of the lamp axis.

Preferably, the contact breaking means comprise an actuation member to set the switching member to the connected state. The actuation member allows to manually connect or reconnect the contact elements with each other, for example in case of maintenance of the lamp fixture or an unintended removal of the LED lamp from the fixture.

Additionally, the present embodiment allows providing a factory new LED lamp in said disconnected state to further enhance the safety of the device. In this case, the user may first install the lamp safely in the lamp fixture and then activate the actuation member to bring the switching member to the connected state. According to the present embodiment, even if the user would install the lamp in the sockets of the fixture successively, no hazardous voltage is present when touching an exposed contact element. The actuation member should preferably be easily accessible from the outside of the LED lamp and may e.g. be formed with a push-button, accessible through an opening in the lamp cap. Most preferably, the actuation member is integrally formed with said switching member.

According to an embodiment of the invention the switching member comprises at least one latching section, adapted to engage with a locking device in said connected state and said contact breaking means further comprise a spring element, biasing said switching member towards said disconnected state.

The locking device holds the switching member in the connected state, e.g. when a user operates the activation member, so that the LED lamp is safely set to an operational state when installed in the fixture. The locking device and the latching section should be adapted to each other, so that the locking device provides the switching member to be kept safely in the connected state. The locking device may for example engage with said latching section mechanically, e.g. using a suitable recess, or by magnetic force.

The spring element may be of any suitable type, e.g. a coil spring, and causes that in case the lamp is removed from the fixture, the switching member moves to the disconnected state.

Preferably, the locking device comprises two locking members, which engage with two latching sections of the switching member to further improve the reliability of the lamp. Most preferably, the locking device is biased to an engaged state, in which the locking device is engageable with said latching section.

According to a preferred embodiment of the invention, the first lamp cap further comprises a release element, said release element be displaceable relative to said locking device, so that in an activated state, said release element provides disengagement of said latching section from said locking device.

The release element thus allows in its activated state to disengage the switching member from the locking device, so that the biased switching member moves to the disconnected state.

The release element may be of any suitable geometry and may be activated e.g. by rotational movement about the lamp axis. Alternatively or additionally, the release element may be activated by linear displacement, preferably along an axis, perpendicular to the lamp axis. Preferably, the release element is activated when the LED lamp is rotated and/or displaced linearly against the lamp fixture. Most preferably, the release element is biased toward an inactive state, so that an accidental activation can be avoided.

According to a embodiment of the invention, the locking device is mounted to a cap housing. The contact element of said first lamp cap and said release element are mounted to a release base plate, which is pivotably connected with the cap housing and is pivotable about a longitudinal axis of the LED lamp from an operational position to a first release position, in which said release element is activated.

The present embodiment advantageously allows a safe disconnection of the contact elements from each other when the lamp is removed from said first type of fixture. As discussed above, to remove the lamp from said first type of fixture, the lamp is rotated by a user to an installation position. During the rotational movement, the lamp is pivoted against the release base plate so that the release base plate is set to the first release position, activating the release element. The activation of the release element provides disengagement of the switching member from the locking device and thus moves the biased switching member to the disconnected state, allowing a safe removal of the lamp from the fixture.

The cap housing and the release base plate may have any suitable geometry, but should provide a sufficient electrical isolation to any life electrical parts. Preferably, the cap housing is at least partly made from plastic material. The release base plate may preferably form a longitudinal end of said first lamp cap.

The base plate should preferably be provided with a stop, so that once the release position is reached, the lamp and the base plate may be jointly rotated to bring the socket of the fixture to the installation position, in which the lamp can be detached from the fixture. Most preferably, the base plate is biased toward the operational position.

According to a preferred embodiment of the invention, the at least one contact element of said first lamp cap is fixed to said release element, so that the contact element and the release element are jointly displaceable against the cap housing along an axis, perpendicular to the longitudinal axis of the LED lamp from an operational position to a second release position, in which said release element is activated. The present embodiment is especially advantageous when the LED lamp is employed in a lamp fixture of said second type, as mentioned above.

To remove the LED lamp from said type of lamp fixture, a linear force is applied to the lamp by a user to disconnect the contact elements from the sockets of the fixture. According to the present embodiment, during deinstallation, the force applied by the user displaces the contact element and the release element to the second release position, activating the release element.

Again, the activation of the release element sets the biased switching member to the disconnected state, allowing a safe removal of the lamp from the fixture. Preferably, the elements are biased toward the operational position, so that without a force being applied to the lamp, the elements and thus the lamp are safely kept in the operational position.

Most preferably, the locking device comprises at least one tongue, said tongue having a recess and being displaceable from an engaged state, in which said recess is engageable with the latching section of the switching member, to a disengage state, in which the recess is disengaged from the latching section. The tongue is biased toward the engaged state.

The present setup allows a cost efficient setup of the locking device while providing that the switching member can be safely kept in the connected state.

The tongue is biased toward said engaged state, either by a suitable biasing element, such as a spring or by manufacturing the tongue at least partly from an elastic material, such as spring steel.

Preferably, the tongue extends along a first axis, perpendicular to the longitudinal axis of the lamp. Most preferably, the tongue is displaceable from the engaged state to the disengaged state along a second axis, perpendicular to the first axis and the lamp axis.

According to a development of the invention, the locking device comprises two tongues, arranged spaced from each by said release element. The release element is provided to increase the distance between the tongues to displace the tongues from the engaged state to the disengaged state.

The present embodiment provides a cost efficient setup of the device. As mentioned, the release element is arranged between said tongues to move the tongues apart, when activated. Preferably, the tongues extend parallel to each other and along a first axis, perpendicular to the lamp axis. Most preferably, the tongues are spaced from each along a second axis, perpendicular to said first axis and the longitudinal axis of the lamp. The release element may for example be provided as a block-shaped or cuboid member, which is rotated about the lamp axis to a diagonal position when activated, so that the extend of the release element in a direction parallel to said second axis is increased, pushing the tongues apart.

Additionally or alternatively, the release element may be provided with at least one projection, arranged facing one of said tongues and extending parallel to said second axis. A pocket is provided in said tongue to receive the projection in the engaged state. According to the present embodiment, said release element, when activated, is displaced parallel to said first axis and said projection is shifted out of said pocket, moving the tongue outward and thus increasing the distance between the tongues to disengage the tongues from the latching section of the switching member.

Most preferably, the release element is provided with two projections, arranged on opposing sides of said release element, said projections being received in corresponding pockets of said two tongues.

According to a further embodiment of the invention, a lamp cap for an LED lamp, which lamp comprising at least one LED unit, is provided with at least one contact element for connecting said LED unit with a lamp fixture and contact breaking means, configured to electrically disconnect said at least one contact element from said LED lamp, when said LED lamp is removed from said lamp fixture.

The lamp cap according to the present aspect provides improved safety to the LED lamp and may be particularly used for retrofit applications. Certainly, the present lamp cap may preferably be adapted according to the embodiments, discussed above.

BRIEF DESCRIPTION OF THE DRAWINGS

The above embodiments of the present invention will become apparent from the following description of preferred embodiments, in which.

DESCRIPTION OF EMBODIMENTS

Figure 1:
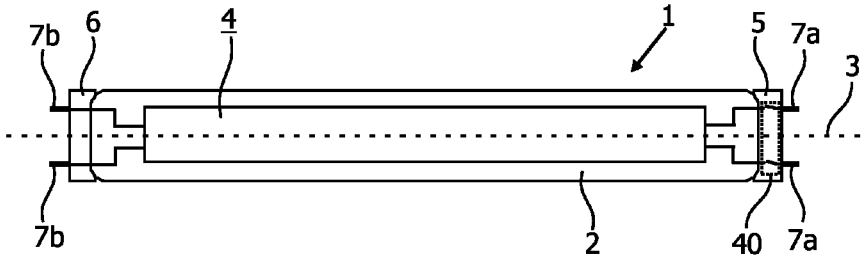
FIG. 1 shows a first embodiment of an LED lamp according to the invention in a schematic side view.
Figure 2:
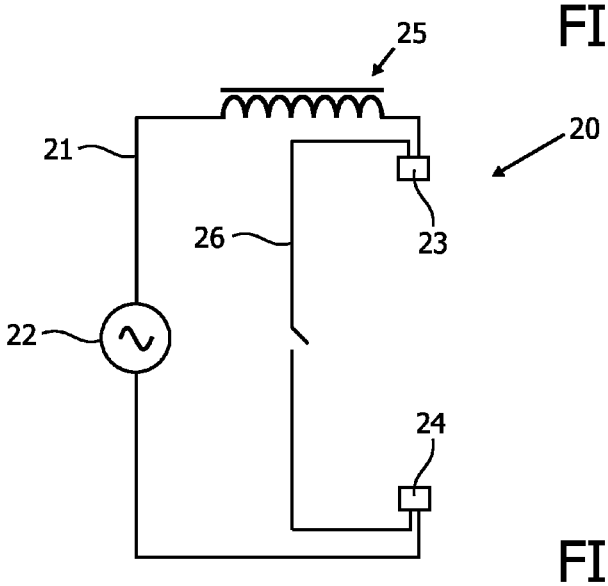
FIG. 2 shows a schematic circuit diagram of an exemplary lamp fixture for connection with the inventive LED lamp.

FIG. 1 shows an embodiment of an LED lamp 1 in a schematic side view. The LED lamp 1 comprises a tube-like housing 2, which extends along a longitudinal lamp axis 3. The housing is made from transparent plastic material, e. g. Polymethylmetacrylate (PMMA). An elongated LED unit 4, comprising several high power light emitting diodes and corresponding control circuitry (both not shown) is arranged along the lamp axis 3 in the housing 2. The LED unit 4 is connected to a first lamp cap 5 and a second lamp cap 6 for connection to a corresponding lamp fixture 20 as shown in FIG. 2, which electrically connects the LED unit 4 to a power supply and also provides mechanical fixation and support of the LED lamp 1. Each of the lamp caps 5, 6 comprise contact pins 7*a* and 7*b*, i.e. a bi-pin base, to electrically connect the lamp caps 5, 6 and thus the LED unit 4 with the lamp fixture 20, i.e. with power.

The LED lamp 1 is a retrofit lamp, adapted for the connection to a lamp fixture 20 for fluorescent linear tube lamps. In the present case, the fixture 20 is suitable for TL-D 36 W lamps, i.e. for a T8-tube, having a length of approx. 120 cm.

FIG. 2 shows the circuit diagram of a typical fluorescent lamp fixture 20. The fixture 20 comprises a main circuit 21, which is connected to a power supply 22, such as mains. The main circuit 21 connects the power supply 22 with a first 23 and second 24 lamp socket for the connection with a corresponding lamp 1. Both sockets 23, 24 are of G13 type. A series coil 25 usually is employed to limit the current through the main circuit 21. The lamp fixture 20 further comprises an auxiliary circuit 26, which is necessary to start a fluorescent lamp attached to the fixture 20.

When using the lamp fixture 20 with an LED lamp 1, the coil 25 and the auxiliary circuit 26 are not mandatory. However, it is advantageously possible to operate the LED lamp 1 without any structural change to the fixture 20, as will be explained in the following, so that a cost-efficient retrofit is possible.

The fixture 20 shown in FIG. 2 is a "rotating-type" fixture. To install a lamp in the fixture 20, the contact pins 7 of the lamp 1 are introduced in respective pivotable contact slots of the sockets 23, 24 in an installation position. According to the "rotating-type" fixture 20, the lamp 1 is connected with the main circuit 21 and thus with the power supply 22 by rotating the lamp 1 about the lamp axis 3, which will rotate the contact slots of the sockets 23, 24 to an operating position of the fixture 20.

Figure 3:
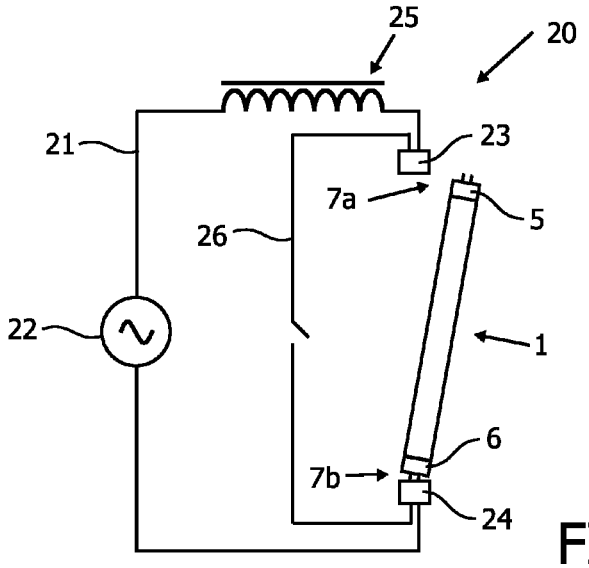
FIG. 3 shows the circuit diagram of FIG. 2 during de-/installation of a LED lamp according to FIG. 1, FIG. 4*a*-4*b* show schematic views of a lamp cap of the LED lamp according to FIG. 1 in a disconnected state.

A typical risk during installation or deinstallation of the lamp 1 in the fixture 20 is that it is possible to connect the lamp with the sockets 23, 24 successively, as shown in FIG. 3. As can be seen from the figure, the second lamp cap 6 is connected with the socket 24 of the fixture 20, while the first lamp cap 23 is unprotected, so that the contact pins 7*a* are exposed and may be touched by the user. Because of a relatively low internal impedance of the LED unit 4—in contrast to a typical fluorescent lamp—mains voltage could easily be present on the contact pins 7*a* of first lamp cap 5, which would result in a high risk of an electric shock for the user during installation or deinstallation.

To reduce said risk, the first lamp cap 5 of the LED lamp 1 according to the present embodiment is provided with a mechanical safety switch arrangement 40, which is described in detail in the following with reference to FIG. 4-6.

Figure 4A:
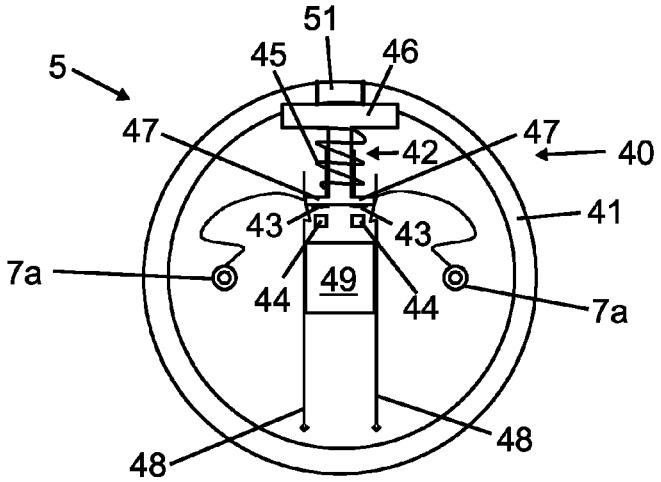

FIG. 4*a* shows a schematic front view of the first lamp cap 5 of the LED lamp 1 in the direction of the lamp axis 3. The lamp cap 5 comprises a tube-like cap housing 41, which is connected to the housing 2 of the lamp 1, as shown in the schematic side view of FIG. 4*b* by the dotted lines. For reasons of clarity, the cap housing 41 is partly removed in the side-view of FIG. 4*b*.

The safety switch arrangement 40 according to the present embodiment comprises a switching member 42. The switching member 42 is supported in guiding sleeve 52 and is movable between a disconnected state, shown in FIGS. 4*a* and 4*b*, to a connected state, shown in FIGS. 5*a* and 5*b*. As can be seen from FIGS. 4*b* and 5*b*, the switching member 42 comprises first contacts 43, connected with the contact pins 7*a* using flexible wires. In the connected state, the first contacts 43 are in electrical contact with corresponding second contacts 44, which extend through the cap housing 41 into lamp housing 2 and are connected with the LED unit 4 (not shown in FIG. 4-6).

Figure 4B:
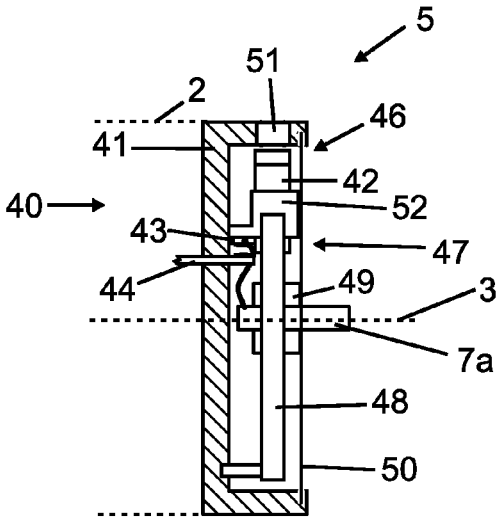
Figure 5A:
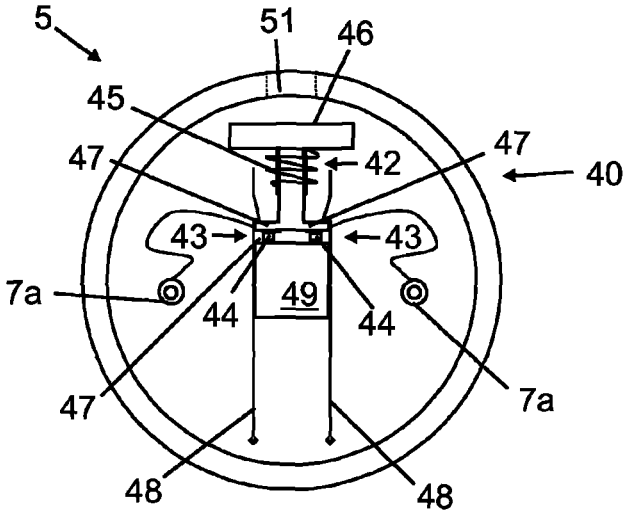
FIG. 5*a*-5*b* show the embodiment of FIG. 4 in a connected state.
Figure 5B:
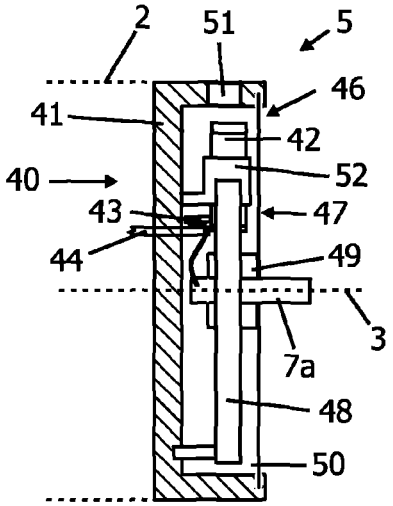
Figure 6A:
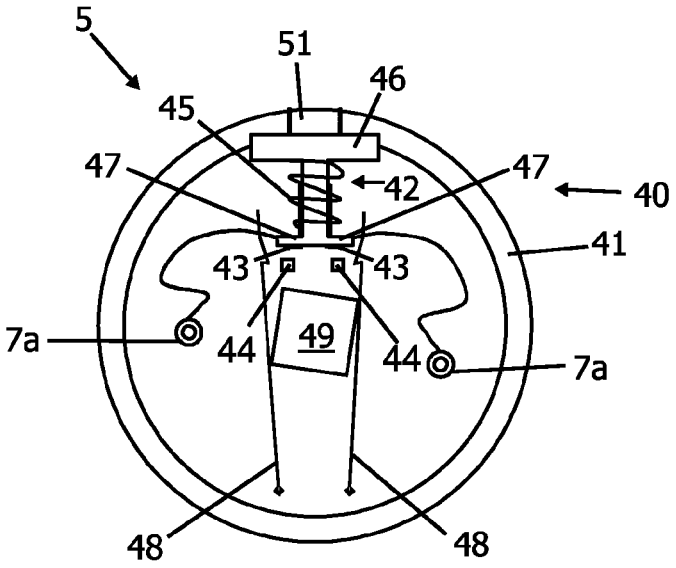
FIG. 6*a*-6*b* show the embodiment of FIG. 4 in a first release position.
Figure 6B:
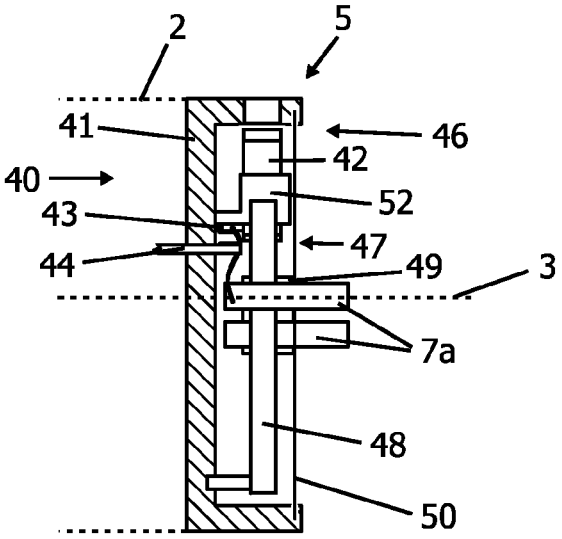

Although the side-views of FIGS. 4*b*, 5*b* and 6*b* only show a pair of first and second contacts 43, 44, the setup of the respective other pair is identical to the shown arrangement. In the connected state, the LED unit 4 is connected with the two contact pins 7*a* and thus, when installed in the fixture 20, with the power supply 22. In the disconnected state, shown in FIGS. 4*a* and 4*b*, the connection between the two contact pins 7*a* of the first lamp cap 5 and the LED unit 4 is interrupted, i.e. the contact pins 7*a* of the first lamp cap 5 are disconnected from the contact pins 7*b* of the second lamp cap 6. The switching member 42 is biased toward the disconnected state by coil spring 45 (not shown in FIG. 4*b*).

Prior to installation of the lamp 1 in the fixture 20, the safety switch 40 is in the disconnected state, so that it is safe to touch the contact pins 7, even if one of the lamp caps 5, 6 is connected with the fixture 20, as shown in FIG. 3. When the installation is complete, the user depresses an actuation member 46, which is accessible through an opening 51 in the cap housing 41. The actuation member 46 is formed integrally with the switching member 42 and thus moves the switching member 42 to the connected state; the lamp 1 in this state is operational.

As shown in FIGS. 5*a* and 5*b*, in the connected state, two latching arms 47 of the switching member 42 engage with corresponding recesses, formed in two spaced elastic tongues 48, so that the switching member 42 is safely kept in the connected state. The tongues 48 form a locking device and are mounted to the cap housing 41. The tongues 48 are made from spring steel and are biased toward an engaged state, as shown in FIG. 5*a*.

A release element 49 extends along the lamp axis 3 between the tongues 48 to provide disengagement of the tongues 48 from the switching member 42 when the lamp 1 is removed from the fixture 20.

The release element 49 is cuboid and mounted to a release base plate 50, e.g. shown in FIG. 4*b*. For reasons of clarity, the base plate 50 is not shown in the front views of FIGS. 4*a*, 5*a* and 6*a*. The release base plate 50 is pivoably mounted to the cap housing 41 in a corresponding circumferential groove and forms an axial end of the LED lamp 1. As can be seen from e.g. FIG. 4*b*, the base plate 50 also supports the contact pins 7*a*.

When said LED lamp 1 is removed from the fixture 20, the lamp 1 is rotated by a user about the lamp axis 3 to move the slots of the sockets 23, 24 to the installation position. Since the contact pins 7*a* are installed in the slots of the fixture 20, the rotational force causes the base plate 50 to pivot against the cap housing 41 and thus the housing 2 from an operational position, e. g. according to FIGS. 5*a* and 5*b*, to a first release position, as shown in FIGS. 6*a* and 6*b*. The rotational movement of the base plate 50 and thus of the release element 49 activates said release element 49, which pushes the tongues 48 apart and provides disengagement of the tongues 48 from the switching member 42. The switching member 42, due to the bias of the spring 45, is reset to the disconnected state, so that the connection between the lamp caps 5, 6 is interrupted and LED lamp 1 may be safely removed from the fixture 20. In case a re-connection is needed, the user may simply depress the actuation member 46 again after the base plate 50 is reset to the operational position.

The base plate 50 is provided with a stop (not shown) so that after the release element 49 is activated by rotation of the lamp 1, further rotational movement of the lamp 1 moves the slots of the sockets 23, 24 to the installation position to allow removal of the lamp 1 from the fixture 20. The angle of rotation to pivot the release base plate 50 from the operational position to the first release position according to the present embodiment is 10°-15°.

FIG. 7-9 show a second embodiment of a first lamp cap 5' of a LED lamp 1. The present embodiment corresponds substantially to the embodiment of FIG. 4-6 with the exception of a modified release base plate 50', which provides a safe disconnection of the contact pins 7*a* from the LED unit 4 also in case the LED lamp 1 is mounted to a "linear-type" fixture (not shown). Here, the contact pins 7 are installed to or deinstalled from the slots, formed in the sockets of such fixture by a linear drawing movement.

Typically, the contact pins 7 are clamped in the operating position in the sockets 23, 24 by contact-springs to safely hold the lamp.

Figure 7A:
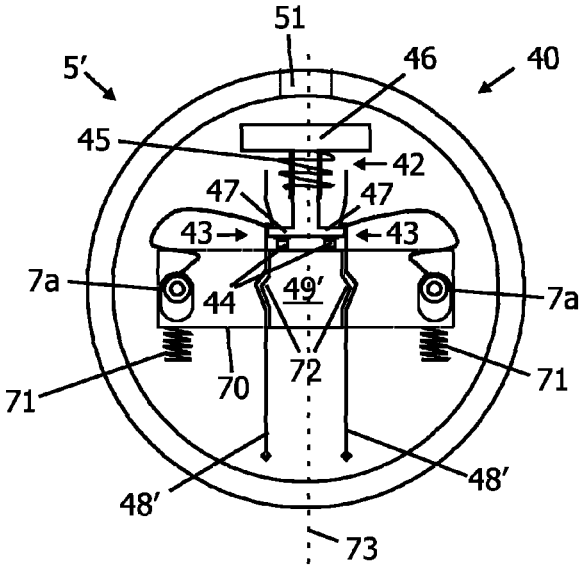
FIG. 7*a*-7*b* show schematic views of a lamp cap of a LED lamp in a connected state according to a second embodiment.
Figure 7B:
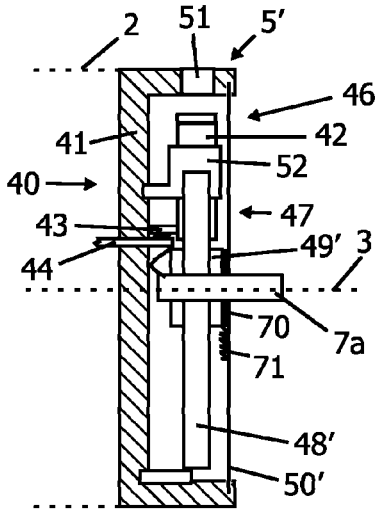

As can be seen in particular from the views of FIGS. 7*a* and 7*b*, which show the switching members 42 in the connected state, the two contact pins 7*a* and the release element 49' are fixed to a linear mount 70, which is connected with the base plate 50'. The linear mount 70 is movable against the base plate 50' along axis 73, perpendicular to the lamp axis 3. The linear mount 70 is biased toward an operational position by two springs 71, which springs 71 are connected to the base plate 50'. The base plate 50' comprises two oval openings through which the pins 7*a* extend.

The release element 49' comprises two projections 72, which in the operational position, shown in FIGS. 7*a* and 7*b*, are received in corresponding pockets of the tongues 48', which extend in a direction, perpendicular to the lamp axis 3 and the axis 73.

Figure 8A:
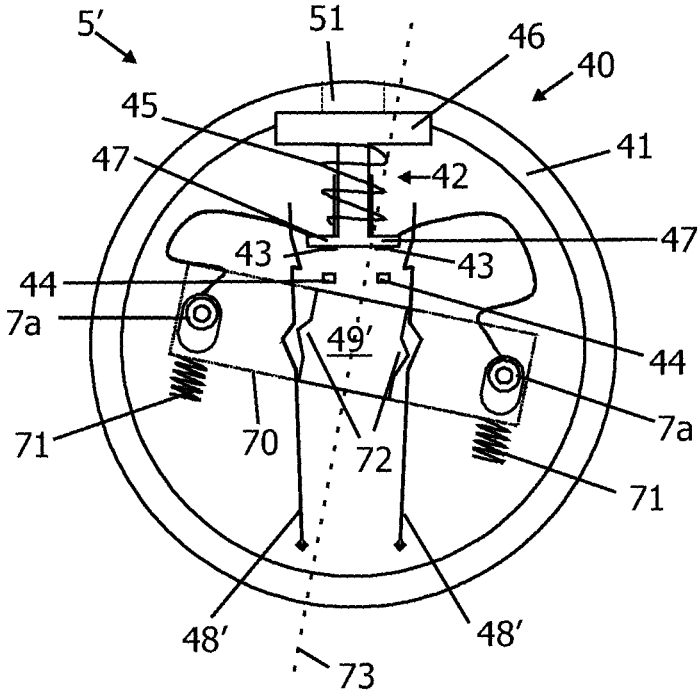
FIG. 8*a*-8*b* show the embodiment of FIG. 7 in a first release position.
Figure 8B:
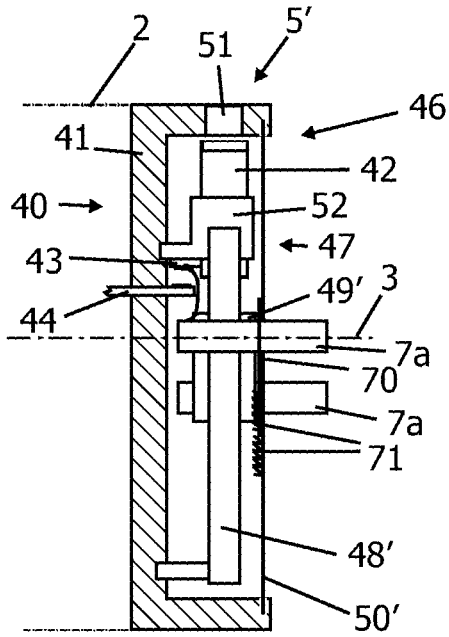

In case the lamp 1 according to the present embodiment is employed with a rotating-type lamp fixture 20, the release base plate 50' is pivoted to the first release position as can be seen from FIGS. 8*a* and 8*b*. In this case, the linear mount 70 is kept in the operational position and the switching member 42 is disengaged from the tongues 48' as explained with reference to the embodiment of FIGS. 6*a* and 6*b*.

Figure 9A:
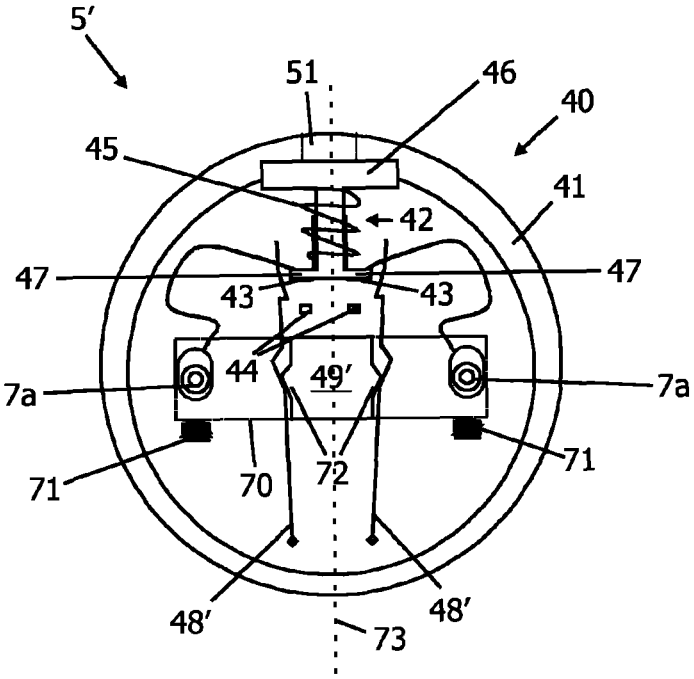
FIG. 9*a*-9*b* show the embodiment of FIG. 7 in a second release position.
Figure 9B:
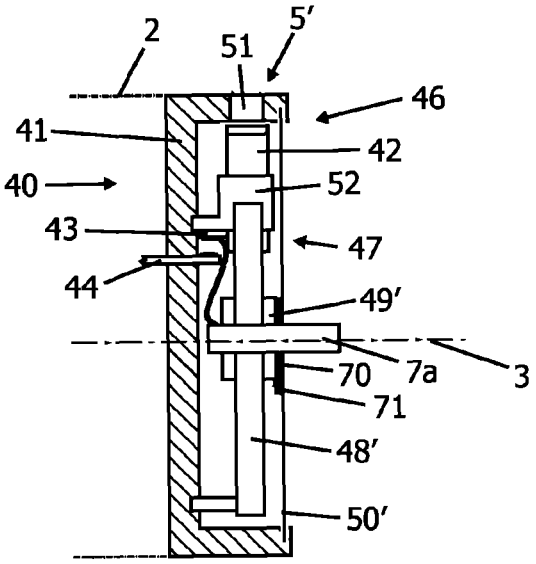

In case of a removal from a linear-type of fixture, the applied linear force shifts the linear mount 70 to a second release position, as shown in FIGS. 9*a* and 9*b*, because of the holding force of the contact-springs in the sockets of the linear-type fixture. A stop is provided (not shown) to allow a removal of the lamp 1 from the fixture, once the linear mount 70 reached the second release position. In this position, the release element 49' and thus the projections 72 are shifted correspondingly in the direction of axis 73. The movement of the mount 70 causes the projections 72 to leave the pockets of the tongues 48', so that the projections 72 move the tongues 48' apart, disengaging the switching member 42 from the recesses of the tongues 48'. Accordingly, the contact pins 7 are disconnected from each other and the lamp 1 can be removed safely from the fixture.

Figure 10A:
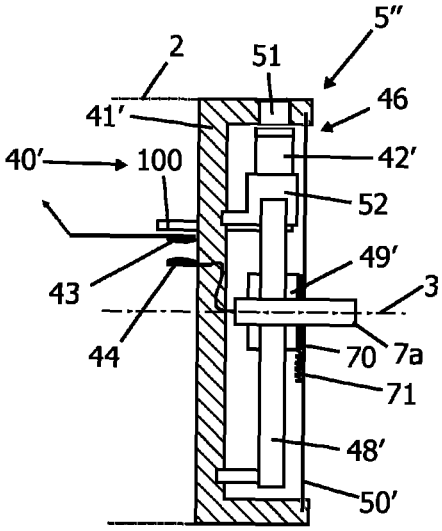
FIG. 10*a*-10*b* show side views of a third embodiment of a lamp cap of a LED lamp and FIG. 11*a*-11*b* show side views of a fourth embodiment of a lamp cap of a LED lamp.
Figure 10B:
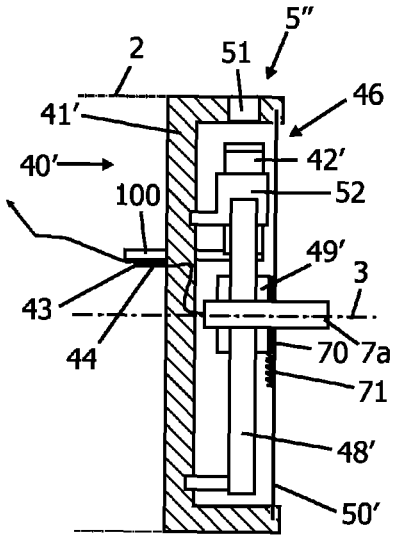

FIGS. 10*a* and 10*b* show a third embodiment of a lamp cap 5" of an LED lamp 1 which is shown according to the side view of e.g. FIG. 4*b*. While FIG. 10*a* shows the switching member 42' in the disconnected state, FIG. 10*b* shows the switching member 42' in the connected state.

The present embodiment corresponds substantially to the embodiment of FIG. 7-9, however, in contrast to the above embodiment, the safety switching arrangement 40' and in particular the switching member 42' comprises a contact arm 100, extending through an elongate opening (not shown) in the cap housing 41' into the housing 2 of the lamp 1. The contact arm 100 holds first contacts 43, connected to the LED unit 4 (not shown). The two contact pins 7*a* according to the present embodiment are connected to second contacts 44. Although the side views of FIGS. 10*a* and 10*b* only show one pair of the first 43 and second contacts 44, the arrangement of the other pair of contacts 43 and 44 corresponds to the shown setup. The operation of the switching member 42' corresponds to the embodiments, explained above. The arrangement of the contacts 43, 44 in the housing 2, as shown, allows a reduced size lamp cap 5 and further improved safety in terms of isolation voltage.

Figure 11A:
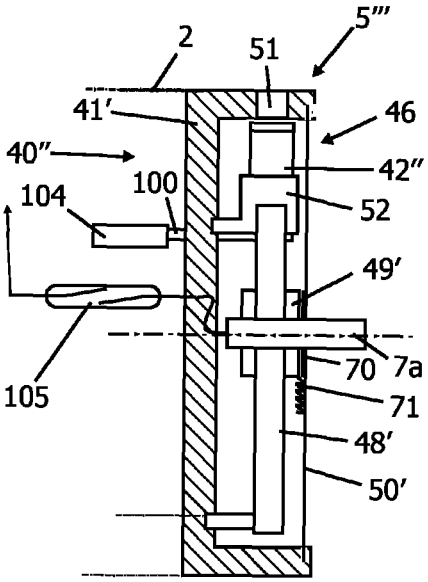
Figure 11B:
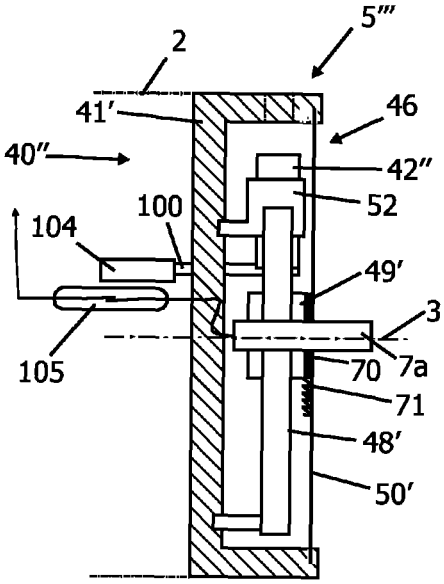

A fourth embodiment of a lamp cap 5''' is shown in FIGS. 11*a* and 11*b* according to the side view of e.g. FIG. 4*b*. The present embodiment corresponds substantially to the embodiment of FIGS. 10*a* and 10*b*. However, the contact arm 100 according to the present embodiment comprises a permanent magnet 104. The contact pins 7*a* are connected to the LED unit 4 (not shown) using reed switches 105.

FIG. 11*a* shows the switching member 42" in the disconnected state. The reed switches 105 are in an open position. When the switching member 42" is set to the connected state, as shown in FIG. 11*b*, the movement of the switching member 42" accordingly shifts the permanent magnet 104 in the vicinity of the reed switches 105, which upon the presence of a magnetic field of a sufficient magnitude, connect the contact pins 7*a* with the LED unit 4.

The invention has been illustrated and described in detail in the drawings and the foregoing description. Such illustration and description are to be considered illustrative or exemplary and not restrictive; the invention is not limited to the disclosed embodiments. It may for example be possible to operate the invention according to an embodiment, in which:

- the housing 2 is made from glass or a further transparent material,
- instead of a single LED unit 4, a plurality of LED units 4 are provided in housing 2,
- instead of a pi-bin arrangement, each lamp cap 5, 6 comprises only a single contact pin 7,
- both lamp caps 5, 6 are provided with a safety switching arrangement 40, 40' or 40",
- the setup of lamp cap 6 corresponds to the setup of first lamp cap 5, 5', 5", 5''',
- said first lamp cap 5, 5', 5", 5''' is provided with a single tongue 48, 48' only and/or
- the safety switching arrangement 40' or 40" according to FIG. 10 or 11 is used in connection with the embodiment of FIG. 4-7.

In the claims, the word "comprising" does not exclude other elements, and indefinite article "are" or "an" does not exclude a plurality. The mere fact that certain measures are recited in mutually different dependent claims does not indicate that a combination of these measures can not be used to advantage. Any reference signs in the claims should not be construed as limiting the scope.

The invention claimed is:

1. An LED lamp, comprising:

one LED unit arranged in a housing, a first and a second lamp cap being arranged spaced from each other on opposing ends of the housing, said lamp caps each comprising at least one contact element for connecting said LED unit with a lamp fixture, wherein said first lamp cap comprises contact breaking means, configured to electrically disconnect said contact elements of said first and second lamp caps from each other when said LED lamp is removed from said lamp fixture;

wherein said contact breaking means comprise a switching member, which is displaceable from a connected state, in which said contact elements are connected with each other, to a disconnected state, in which said contact elements are disconnected from each other;

wherein said switching member comprises at least one latching section, adapted to engage with a locking device in said connected state and said contact breaking means further comprise a spring element, biasing said switching member toward said disconnected state.

2. The LED lamp according to claim 1, wherein said contact breaking means are adapted to disconnect said contact elements from each other when said LED lamp is rotated and/or displaced linearly against said lamp fixture.

3. The LED lamp according to claim 1, wherein said contact breaking means are configured to disconnect said at least one contact element of said first lamp cap from said LED unit.

4. The LED lamp according claim 1, wherein said contact breaking means comprise an actuation member to set said switching member to said connected state.

5. The LED lamp according to claim 1, wherein said first lamp cap further comprises a release element, said release element being displaceable relative to said locking device, so that in an activated state, said release element provides disengagement of said latching section from said locking device.

6. The LED lamp according to claim 5, wherein said locking device is mounted to a cap housing and where said contact element of said first lamp cap and said release element are connected with a release base plate, which base plate being pivotably connected with said cap housing and being pivotable about a longitudinal axis of said LED lamp from an operational position to a first release position, in which said release element is activated.

7. The LED lamp according to claim 5, wherein said contact element of said first lamp cap is fixed to said release element, so that said elements are displaceable against said cap housing along an axis, perpendicular to the longitudinal axis of said LED lamp from an operational position to a second release position, in which said release element is activated.

8. The LED lamp according to claim 5, wherein said locking device comprises at least one tongue, said tongue having a recess and being displaceable from an engaged state, in which said recess is engageable with said latching section of said switching member to a disengaged state in which said recess is disengaged from said latching section and where said tongue being biased toward said engaged state.

9. The LED lamp according to claim 8, wherein said locking device comprises two tongue, arranged spaced from each other by said release element in a direction, perpendicular to the longitudinal axis of said LED lamp and wherein said release element is provided to increase the distance between said tongues to displace said tongues from said engaged state to said disengaged state.

10. An LED lamp, comprising:

a plurality of LEDs arranged in a tube shaped housing;

a first and a second lamp cap being arranged spaced from each other on opposing ends of the housing;

each of the lamp caps having at least one contact element electrically connecting the plurality of LEDs with the first and second lamp caps;

wherein the first lamp cap includes a contact break to electrically disconnect the contact elements of the first and second lamp caps from each other when said LED lamp is removed from said lamp fixture;

the contact break including a displaceable switching member actuatable from a connected state to a disconnected state;

wherein the switching member includes at least one latching section adapted to engage with a locking device in the connected state;

said contact break further including a spring element biasing the switching member toward the disconnected state.

11. An LED lamp configured to disconnect first and second lamp caps from each other when the LED lamp is removed from a lamp fixture, comprising:

a plurality of LEDs arranged in a tube shaped housing and forming a current path between a first and a second lamp cap the first and second lamp cap oppositely spaced from each other on opposing ends of the housing;

each of the first and second lamp caps having at least one electrical contact element;

wherein the first lamp cap includes a contact break to electrically disconnect the contact elements of the first and second lamp caps from each other when said LED lamp is removed from the lamp fixture;

the contact break including an actuatable switch actuatable from a connected state to a disconnected state thereby connecting and disconnecting the first and second lamp cap from being in electrical connectivity;

wherein the switching member includes at least one latching section adapted to engage with a locking device in the connected state;

a spring element biasing the switching member toward the disconnected state.

* * * * *